US006039550A

United States Patent [19]

Friedley et al.

[11] Patent Number: 6,039,550

[45] Date of Patent: Mar. 21, 2000

[54] MAGNETIC DEBRIS TRAP

[75] Inventors: Vernon E. Friedley; Thomas R. Barito, both of Arkadelphia, Ark.

[73] Assignee: Scroll Technologies, Arkadelphia, Ak.

[21] Appl. No.: 08/896,446

[22] Filed: Jul. 18, 1997

[51] Int. Cl.[7] ..... F04C 29/02; F01M 1/10

[52] U.S. Cl. ..... 418/55.6; 418/94; 184/6.16; 184/6.18; 184/6.25

[58] Field of Search ..... 418/55.6, 94; 184/6.16, 184/6.18, 6.25

[56] References Cited

U.S. PATENT DOCUMENTS

| | | | |
|---|---|---|---|
| 2,622,942 | 12/1952 | Munoz | 184/6.25 |
| 3,151,703 | 10/1964 | Benk | 184/6.25 |
| 4,724,928 | 2/1988 | Lewis et al. | 184/6.18 |
| 4,877,382 | 10/1989 | Caillat et al. | 418/55.5 |
| 5,013,225 | 5/1991 | Richardson, Jr. | 418/55.6 |
| 5,176,506 | 1/1993 | Siebel | 417/368 |
| 5,345,785 | 9/1994 | Sekigami et al. | 418/55.6 |
| 5,372,490 | 12/1994 | Fain | 418/55.6 |
| 5,383,534 | 1/1995 | Pollier | 184/6.25 |

FOREIGN PATENT DOCUMENTS

| | | | |
|---|---|---|---|
| 62-26394 | 4/1987 | Japan . | |
| 62-129584 | 6/1987 | Japan | 184/6.25 |
| 5-52191 | 3/1993 | Japan | 418/55.6 |

*Primary Examiner*—John J. Vrablik
*Attorney, Agent, or Firm*—Howard & Howard

[57] ABSTRACT

A scroll compressor (10) is disclosed which incorporates a magnet (88) in a depression (90) formed in the lower shell (12) by forming a coined surface (82). The depression forms a side wall (92) which confines the magnet therein so that no additional fastening mechanism is required. The magnet is preferably a ring magnet (88) which is centered about the rotational axis of the drive shaft (40) and near the end of the oil pick-up tube (62) so that oil passes close to the magnet (88) as it enters the oil pick-up tube. The magnet separates magnetic debris, such as metal filings, from the oil. In another embodiment, a pair of magnets (112) can be positioned in multiple coined surfaces on the lower shell.

6 Claims, 9 Drawing Sheets

86
16
20
7
18
3
22
42
5
26
30
32
34
46
30
50A
10
1
66A
38
12
40
36
37
13
50B
67
81
58
62
80
70
88
64
14
66B
80

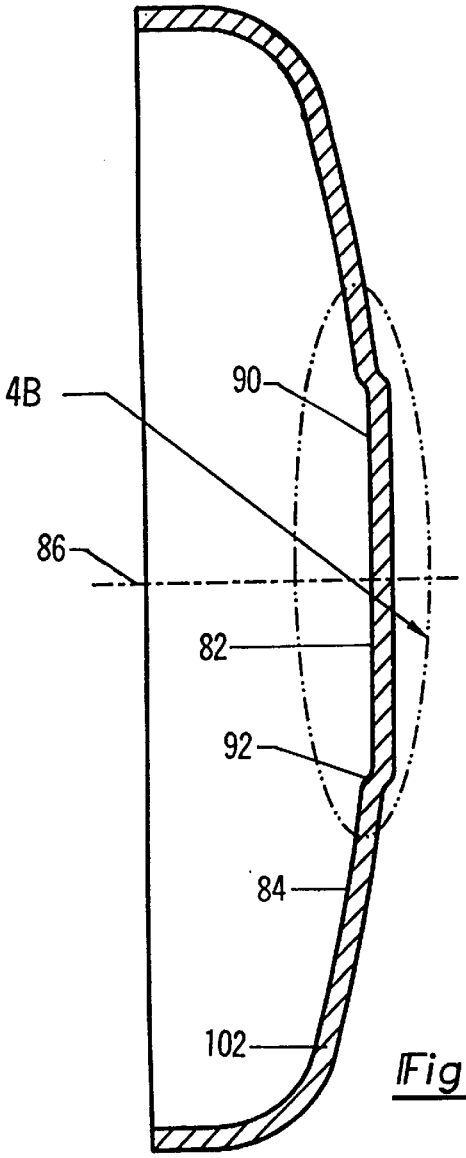
Fig-4A
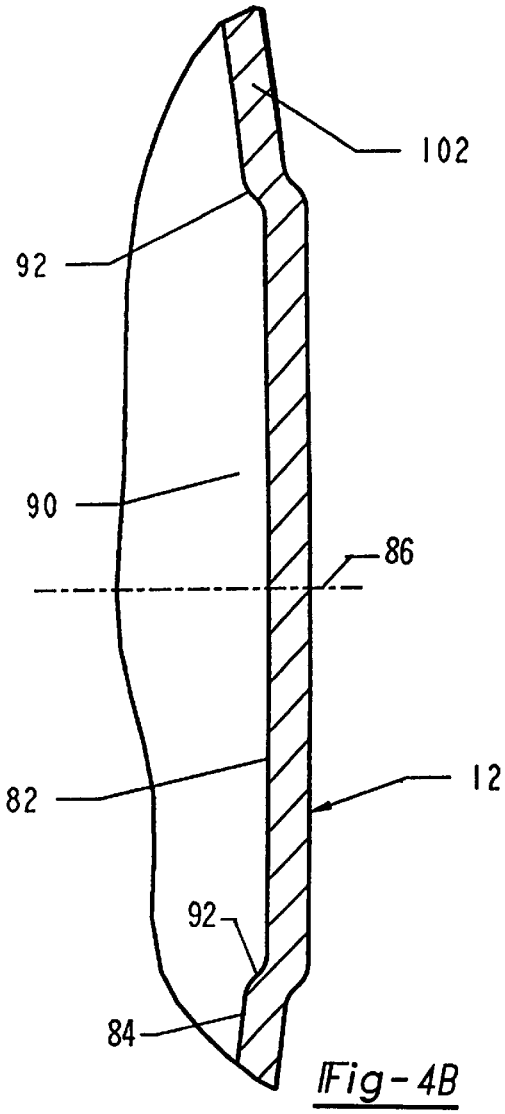
Fig-4B
Fig-5A
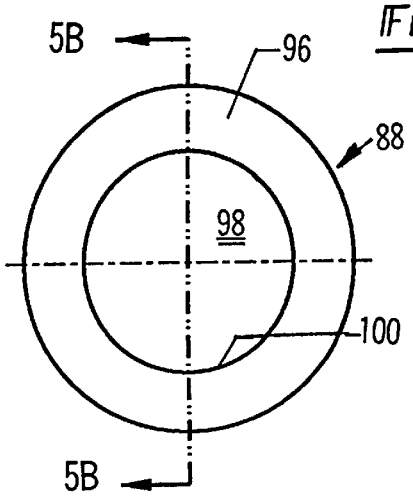
Fig-5B
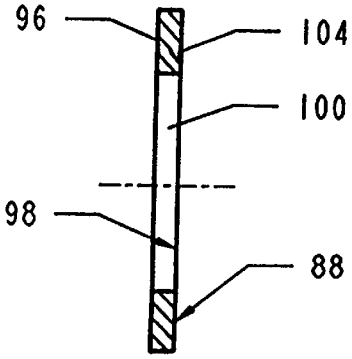

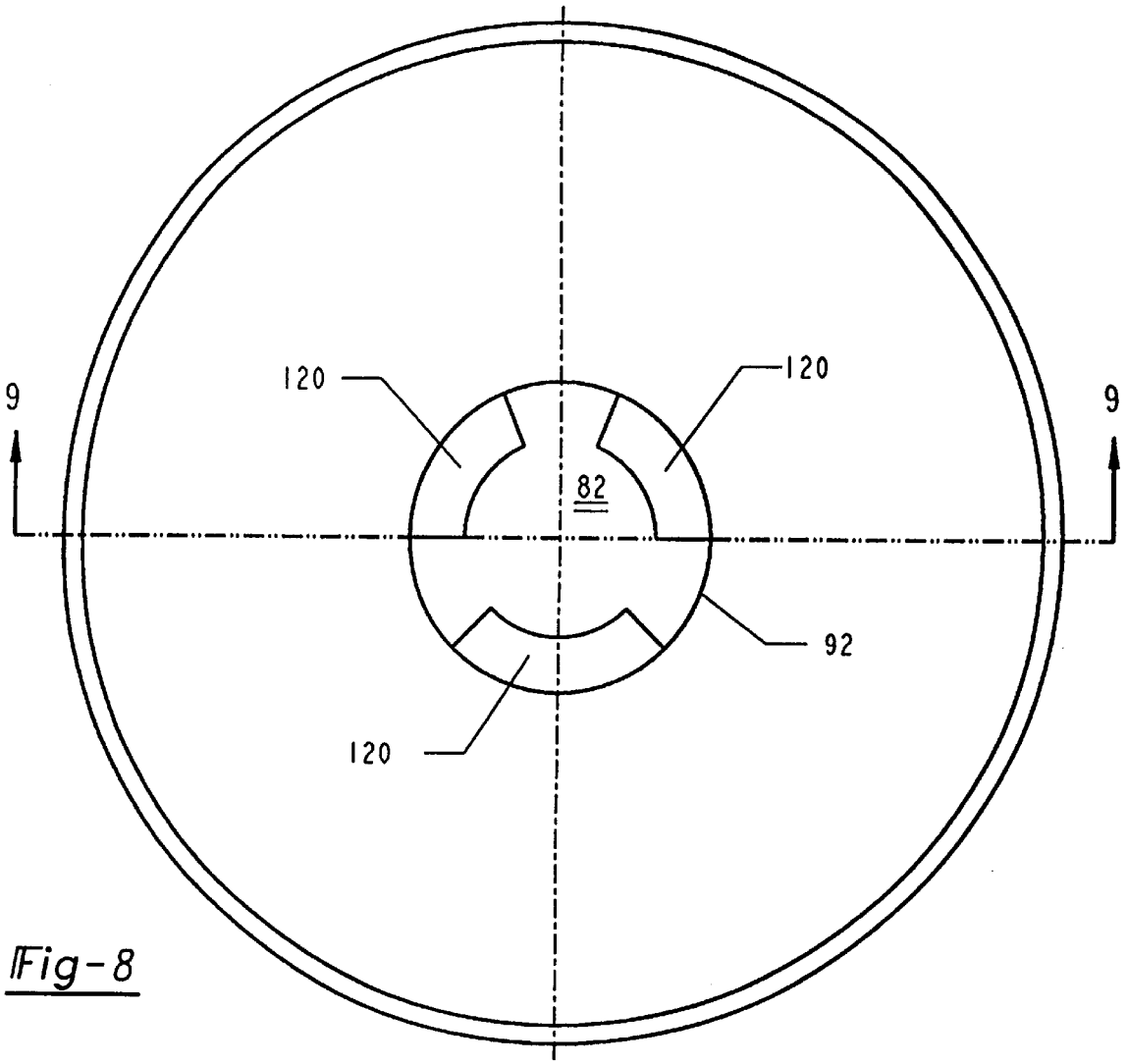
Fig-8
Fig-9
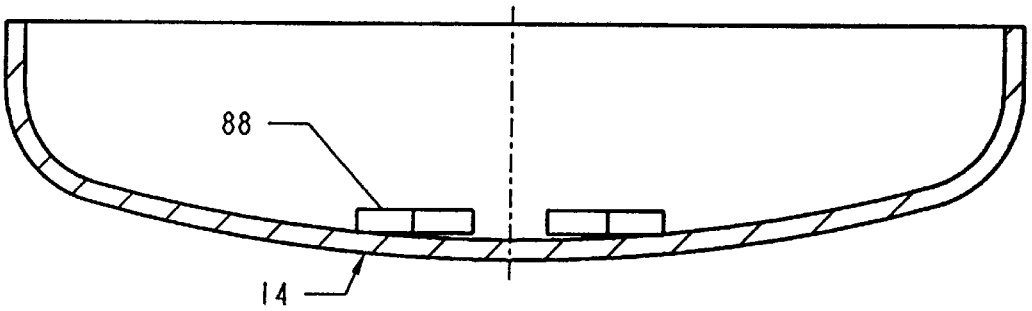

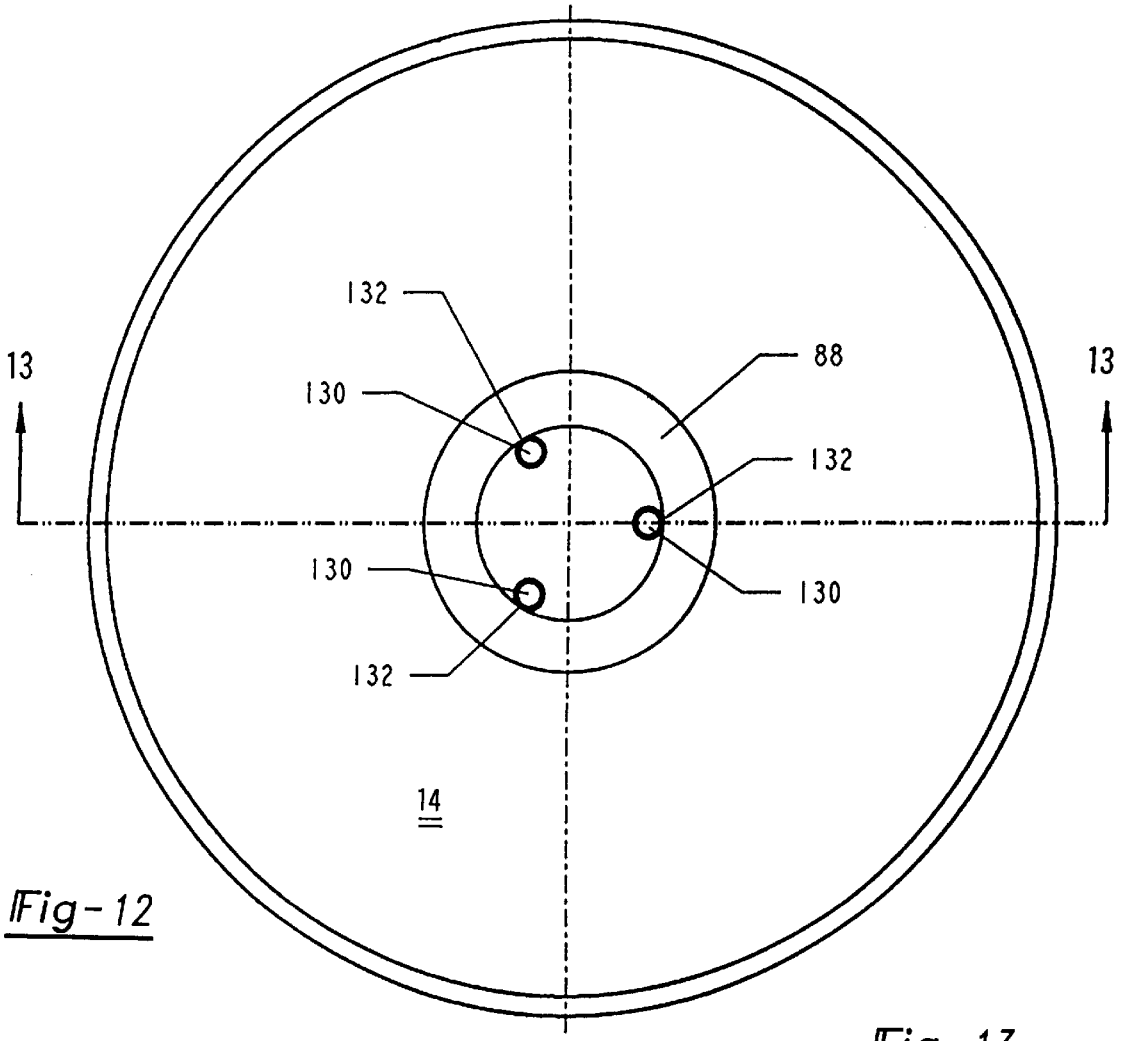
Fig-12
Fig-13
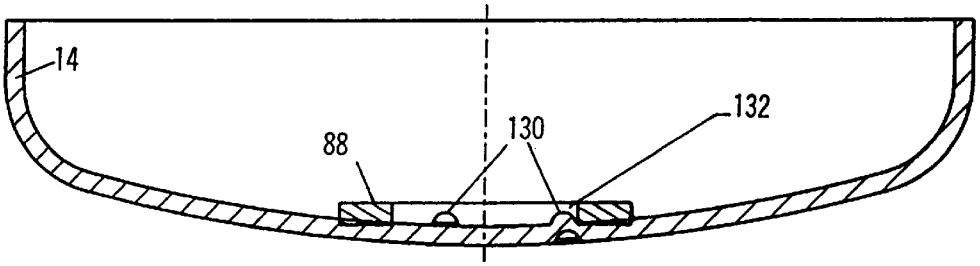

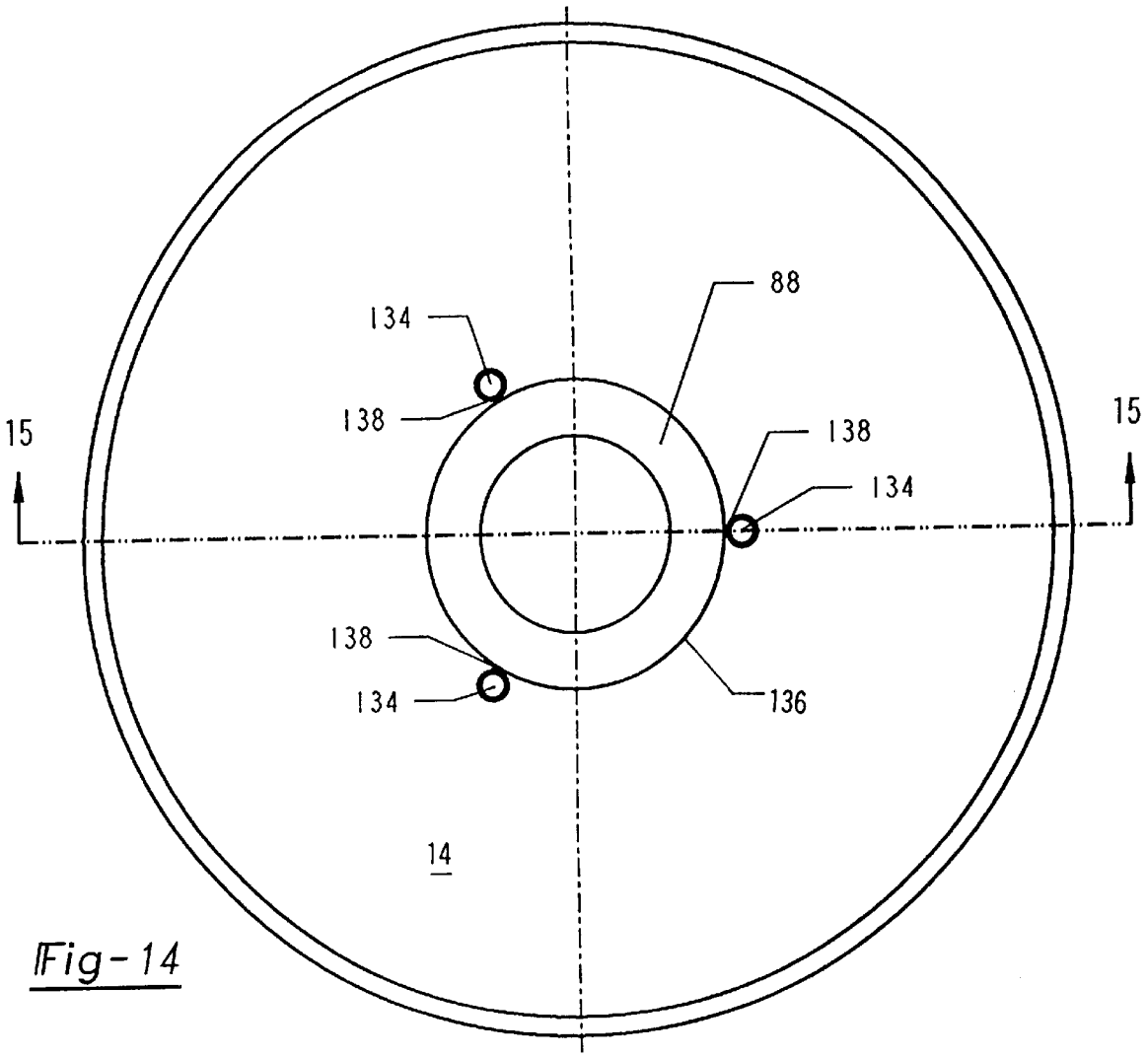
Fig-14
Fig-15
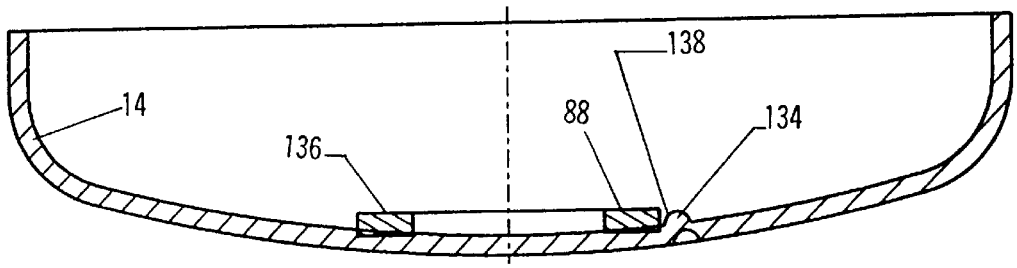

MAGNETIC DEBRIS TRAP

TECHNICAL FIELD

This invention relates to compressors, such as scroll compressors, and in particular to reducing lubricant contaminants in scroll compressors.

BACKGROUND OF THE INVENTION

Scroll compressors are finding increased use in home and office air-conditioning units. In a typical scroll compressor, an orbiting scroll element is moved in an orbital path relative to a fixed scroll element. Each of the scroll elements have a scroll wrap. The scroll wraps of the scroll elements interact to form compression pockets to compress a refrigerant gas.

Normally, the orbiting scroll element is driven by a rotating drive shaft through an offset drive. The drive shaft is normally part of an electric motor which operates within the sealed enclosure of the compressor. The rotation of the drive shaft is typically utilized to circulate a lubricant to various portions of the scroll compressor, with the lubricant recycled by gravity to a sump within the compressor.

As the lubricant is circulated through the compressor, it picks up debris left over either from the manufacturing process or generated by wear of the compressor. It is desirable to remove the debris from the lubricant flow. Conventional filters are impractical as the compressor is permanently hermetically sealed. Magnets have been used to separate debris from the lubricant. Bristol Compressors, Inc. utilizes a small disk magnet in the bottom of their reciprocating compressors. Placement of the magnet is at random. However, a need still exists for an enhanced debris separation mechanism to ensure the lubricant in the compressor does not damage the compressor components.

SUMMARY OF THE INVENTION

In accordance with one aspect of the present invention, a magnet can be mounted on the shell of a compressor and confined thereon by a depression in the shell. The magnet separates debris from lubricant in the compressor. In another aspect, the magnet can be an annular magnet. In yet another aspect, the shell can have a protrusion to secure the magnet.

In accordance with another aspect of the present invention, a scroll compressor is provided which includes a pair of scrolls, at least one of which is an orbiting scroll, and a mechanism to cause the orbiting scroll to orbit relative the other scroll. The scroll compressor further has a lubrication mechanism to transfer a lubricant within the scroll compressor to lubricate components thereof. The scroll compressor further includes a lower shell forming a portion of the compressor enclosure. A depression is formed in the lower shell. A magnet is set within the depression of the lower shell to separate ferrous material from the lubricant.

In accordance with another aspect of the present invention, the scroll compressor has a drive shaft with an oil pick-up tube extending downwardly therefrom. The magnet is an annular magnet concentric with the oil pick-up tube.

In accordance with another aspect of the present invention, the depression in the lower shell is a coined surface.

In accordance with another aspect of the present invention, at least two depressions are formed in the lower shell, at least two magnets being used, each of the depressions receives a magnet.

BRIEF DESCRIPTION OF THE DRAWINGS

A more complete understanding of the invention and its advantages will be apparent from the following detailed description when taken in conjunction with the accompanying drawings, in which:

FIG. 4A is a vertical, cross-sectional view of the lower shell;

FIG. 4B is a detail view of the coined surface of the lower shell of FIG. 4A;

FIG. 5A is a plan view of the magnet used in the compressor;

FIG. 5B is a cross-sectional view of the magnet used in the compressor taken along line 5B—5B in FIG. 5A;

FIG. 8 is a plan view of a segmented magnet;

FIG. 9 is a vertical, sectional view of a modified lower shell with no coined surface;

FIG. 12 is a plan view of a modified lower shell with a plurality of interior protrusions securing the magnet;

FIG. 13 is a vertical, sectional view taken along line 13—13 in FIG. 12;

FIG. 14 is a plan view of a modified lower shell with a plurality of exterior protrusions securing the magnet; and FIG. 15 is a vertical, sectional view taken along line 15—15 in FIG. 14.

DETAILED DESCRIPTION

Figure 1:
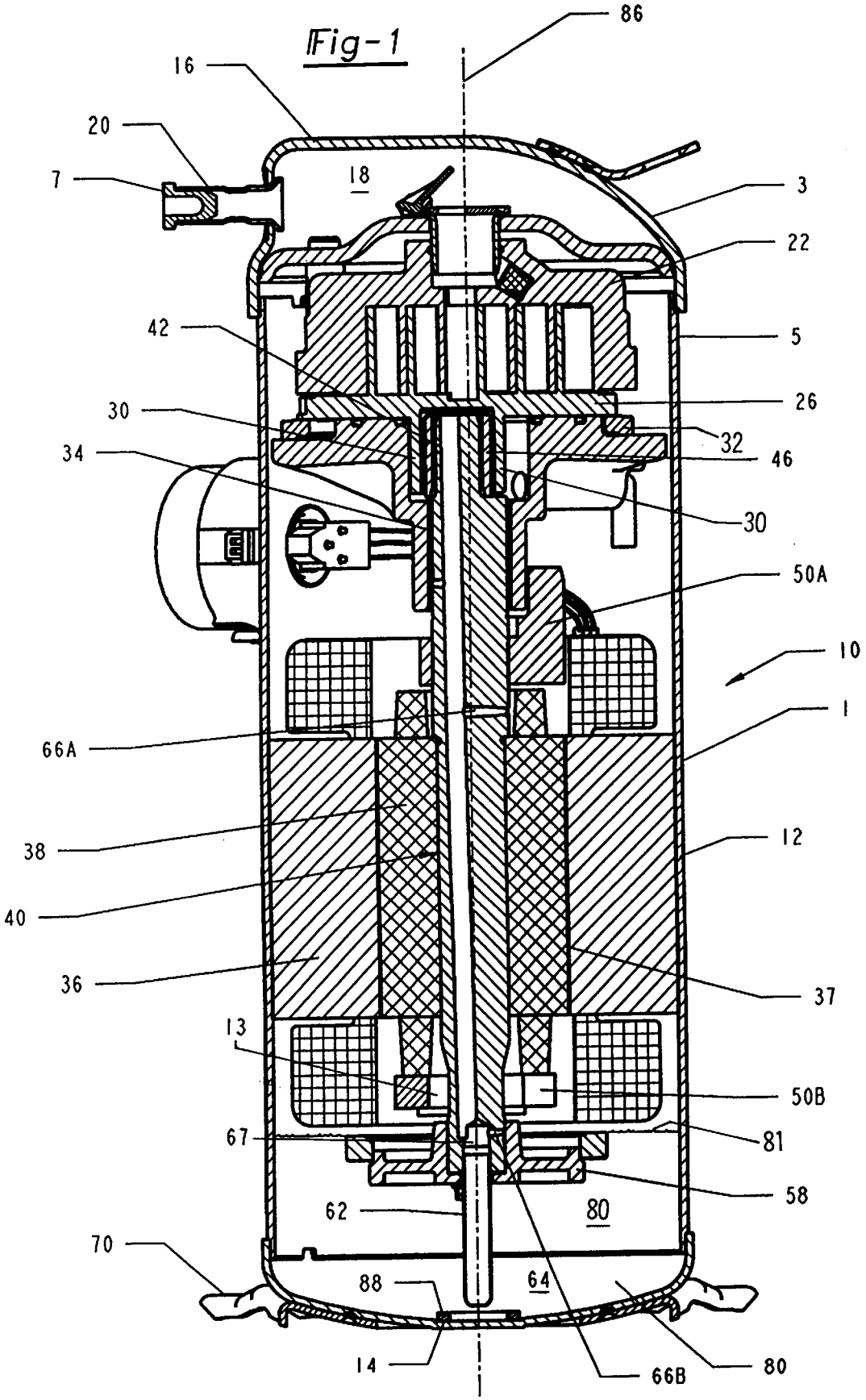
FIG. 1 is a vertical, sectional view of a scroll compressor employing a magnetic debris trap in accordance with the teachings of the present invention.

Referring now to the drawings, wherein like reference numerals designate like or corresponding parts throughout the several views, there is shown in FIG. 1 a scroll compressor 10 which has a fixed scroll 22 mounted in shell or housing 12 and an orbiting scroll 26 which is fixed against rotation by an Oldham coupling 32. The housing 12 is closed at its upper end with an upper shell 16 and at its lower end with a lower shell 14. A baseplate 70 is secured to the lower shell 14 to support the compressor 10 in the vertical orientation. Gas that is compressed in the compressor exits from the center of the fixed scroll which is rigidly mounted within the housing 12, is received in pressure chamber 18 and flows to a high pressure outlet or discharge 20. A female stub or stem 30 extends from the orbiting scroll 26 and is engaged by a portion of a drive shaft 40. The orbiting scroll 26 is fixed against rotation by means of an anti-rotation device, such as an Oldham ring or coupling 32 which prevents rotation of the orbiting scroll 26, but permits the orbiting scroll 26 to revolve without rotation about the center or axis 86 of the fixed scroll 22 and drive shaft 40.

An electric motor drive for the compressor 10 is carried within the compressor housing 12 and includes a stator 36 having a cylindrical passage 37 formed therethrough to receive a rotor assembly 38 rotatably journaled within the compressor housing 12. The rotor 38 is positioned within the generally cylindrical passage 37 formed in the stator 36 resulting in a small annular gap therebetween. Relative motion between the fixed scroll 22 and the orbiting scroll 26 is provided through drive shaft 40 which has the rotor 38 press fit thereto. The drive shaft 40 has a generally cylindrically shaped upper drive pin 42 located at the upper end of the drive shaft 40. Slider block 46 is received on drive pin 42 and is adapted to be received in the stem portion 30 of the orbiting scroll 26. In this manner, rotational motion of the rotor 38 within the stator 36 will cause rotary movement of the drive shaft 40 and the slider block 46 about rotational axis 86. Since the stem 30 is eccentrically located on slider block 46 relative to the axis 86 of drive shaft 40, rotation of the drive shaft 40 will effect an orbiting motion of the orbiting scroll 26 relative to the fixed scroll 22. The drive shaft 40 is journaled within upper bearing 34 and lower bearing 58.

Because the orbiting motion of the orbiting scroll 26 is unbalanced, an upper counterweight 50A is positioned on the drive shaft 40 immediately axially adjacent drive pin 42 and a lower counterweight 50B is positioned near lower bearing 58. The lower end of the drive shaft 40 supported in lower bearing 58 is in a position in fluid communication with an oil sump or reservoir 64 which provides a source of lubrication oil 80 for the various bearing surfaces having an oil level 81.

Oil pick-up tube 62 extends from the chamber 67 in the lower end of the drive shaft 40 and is immersed in the sump 64. Oil distribution bore 66 formed through drive shaft 40 extends in a diverging relationship to the axis 86 of drive shaft 40 so that, as the drive shaft rotates, it acts as a centrifugal pump for pumping lubricant upward from the sump 64 to lubricate the components of the compressor. A suitable number of oil distribution channels such as 66B and vent channel 66A connect with the oil distribution bore 66 to provide venting and lubrication to the upper and lower bearings, as well as any other location where lubrication may be required. The oil returns to the sump 64 by gravity.

As noted, debris, such as metal particles, may be entrained in the oil 80 as it circulates about the compressor. The debris can be from the manufacturing process or generated by wear of the components of the compressor during operation. In accordance with one embodiment of the present invention, the lower shell 14, seen in FIGS. 2 and 3, has a generally hemispherical configuration and has a coined surface 82 (FIGS. 4A and 4B) formed on the inside surface 84 thereof centered on the rotational axis 86 of the drive shaft which defines a depression 90 having annular side walls 92. An annular magnet 88, seen in FIGS. 2, 3, 5A and 5B, is received on the coined surface 82 within depression 90. The material of lower shell 12 is commonly ferrous. The annular magnet 88 therefore is attracted to the lower shell 12 and, when positioned in the depression 90, the side walls 92 prevent movement of the annular magnet 88 therefrom. Thus, no attachment mechanism, such as glue, tabs, bolts or other fastener, need be used to maintain the annular magnet 88 in a desired location within the depression 90. However, if desired, such fastening mechanisms can be used for extra assurance the magnet will not move.

Figure 2:
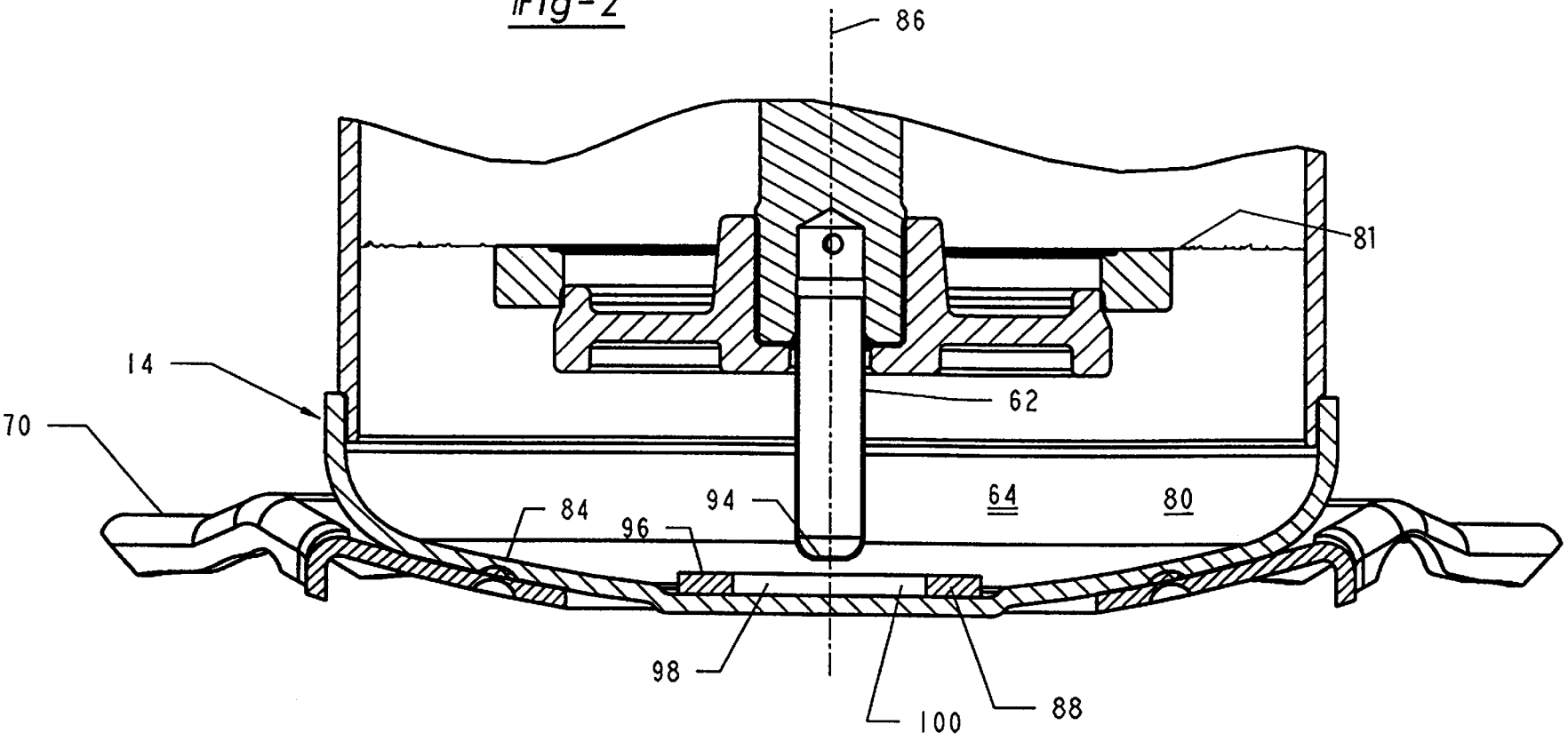
FIG. 2 is a partial vertical, sectional view of the compressor showing the magnetic debris trap.
Figure 3:
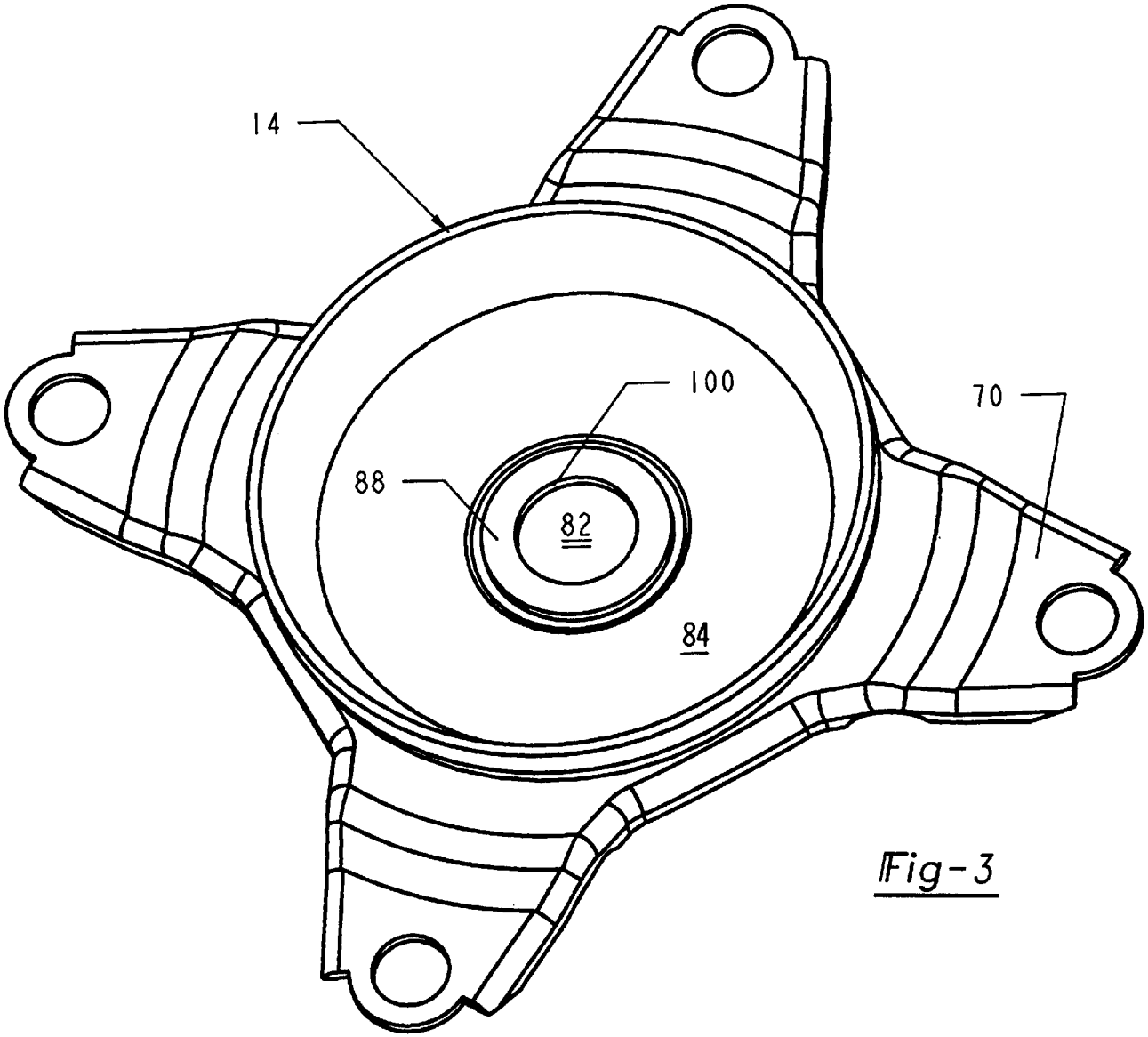
FIG. 3 is a perspective view of the lower shell and base plate of the compressor.

As can best be seen in FIG. 2, the lower end 94 of the oil pick-up tube 62 extends well into the oil 80 below level 81 within the sump 64 and is centered on the rotational axis 86 of the drive shaft. Oil is drawn into the tube at the lower end 94 by the centrifugal action of the rotating drive shaft. The suction at the end 94 draws oil 80 from the sump 64 radially inwardly toward the axis 86 and just over the upper surface 96 of the annular magnet 88. Since all of the oil used for lubrication must enter the end 94 of the oil pick-up tube, inherently, all of the oil will flow within close proximity to the upper surface 96 of the annular magnet 88. Therefore, the magnet will have the opportunity to magnetically remove any debris within the oil that is magnetic, in particular metal filings and the like, which would be particularly harmful to the operating components of the compressor.

Use of an annular magnet 88, having an aperture 98 in the middle thereof centered on the axis 86, allows oil to flow not only over the upper surface 96, but to some degree along the inner surface 100 defining the aperture 98, to enhance the debris collection. However, many different shapes of the magnet could be utilized, including a solid magnet, or a magnet defining a spherical or other curved surface facing the end 94 and centered on the axis 86. The magnet need not be unitary, and, for example, can be formed of a number of discrete segments 120 as shown in FIG. 8, each received in the depression 90 and held therein by the side walls 92 and the magnetic attraction to the lower shell 12. Essentially any configuration of magnet or oil pick-up tube which provides for movement of all or a significant amount of oil used for lubrication near the magnet to remove debris would be desirable. Also, the annular magnet 88 can simply be attached to lower shell 14 by magnetic attraction only, with no coined surface 82 as seen in FIG. 9.

As can best be seen in FIGS. 4A and 4B, the coined surface 82 can be generated with a punch which deforms the wall 102 of the lower shell 14, forming the depression 90 and side walls 92 thereby. The depression 90 is preferably somewhat larger in diameter than the outside diameter of the annular magnet 88 so that the bottom surface 104 of the magnet will be assured to be in contact with the coined surface 82.

Figures 6, 7:
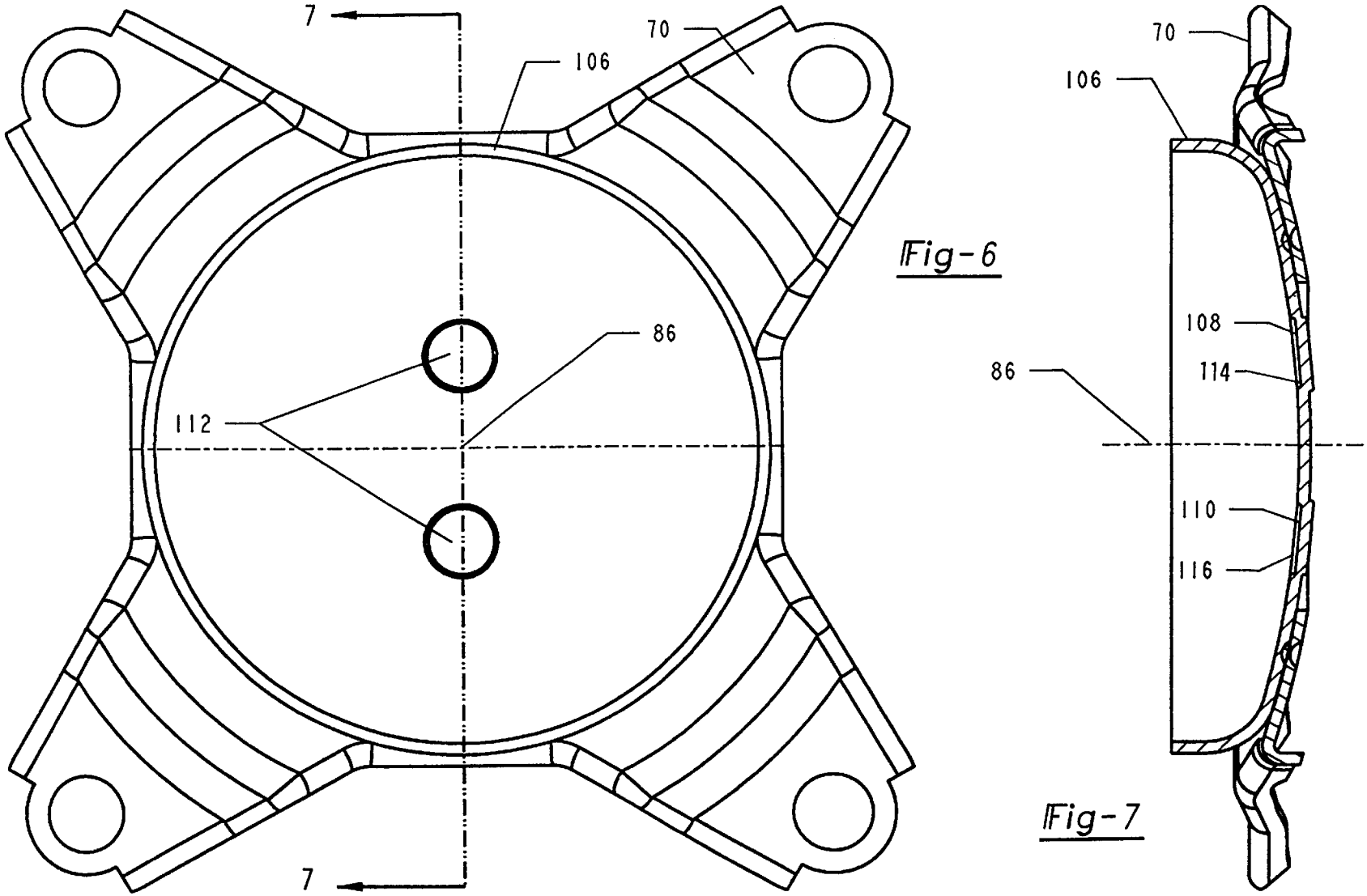
FIG. 6 is a plan view of a modified lower shell employing two magnets.
FIG. 7 is a vertical, sectional view taken along line 7—7 in FIG. 6.

With reference now to FIG. 6 and FIG. 7, a modification of the present invention is illustrated which uses a lower shell 106. In lower shell 106, two coined surfaces 108 and 110 are created, separated from the rotational axis 86. Each coined surface will receive a smaller disc magnet 112 therein. The magnets 112 are retained in place by side walls 114 and 116 formed when the surfaces are coined as well as the magnetic attraction of magnets 112 to lower shell 106. While all of the oil will not pass close to one of the magnets 112 all of the time during oil circulation, sufficient oil will pass close to the magnets to effectively remove debris.

Many other configurations of magnet placement in the lower shell can be contemplated. For example, more than two coined surfaces can be created in the lower shell, with each surface having a magnet secured thereon. In each case, by forming the coined surface, a side wall will be created which acts to confine the magnet within the depression formed, thereby eliminating or reducing the need for further mechanisms to secure the magnet to the shell.

Figure 10:
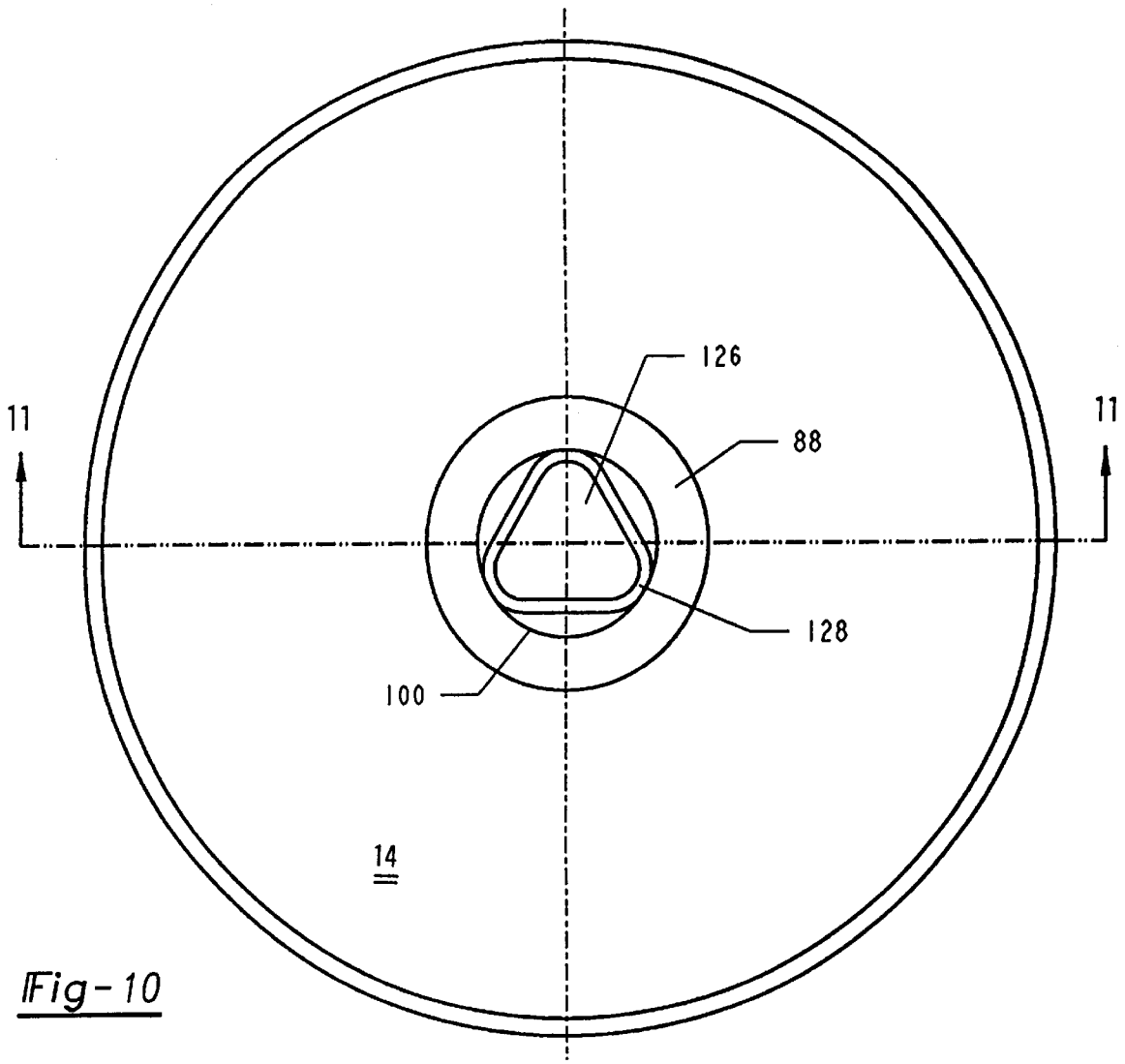
FIG. 10 is a plan view of a modified lower shell with a protrusion securing the magnet.
Figure 11:
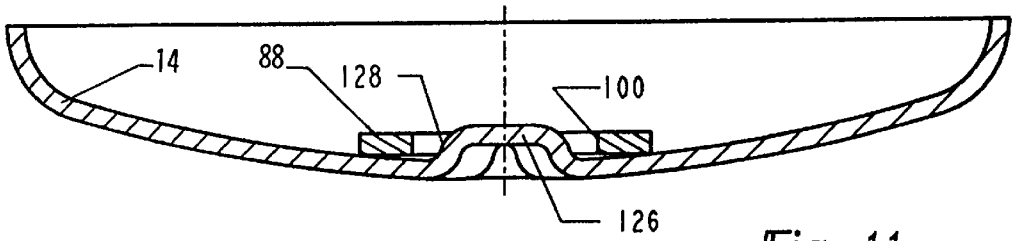
FIG. 11 is a vertical, sectional view taken along line 11—11 in FIG. 10.

In another modification, seen in FIGS. 10 and 11, the lower shell 14 can have an inwardly extending protrusion 126 to hold annular magnet 88 in place. The walls 128 of the protrusion will engage the inner surface 100 of the ring magnet to hold the annular magnet in place. Similarly, several discrete interior annular protrusions 130 can be formed in the lower shell 14 which have walls 132 to confine the annular magnet at inner surface 100 as seen in FIGS. 12 and 13. Several discrete exterior protrusions 134 can be formed outside the magnet perimeter as seen in FIGS. 14 and 15 to contact the outer surface 136 of the annular magnet 88 with surfaces 138 and hold it in place.

It is believed that reduction of the debris in the oil will increase the service life of the bearings, reducing wear thereof.

While several embodiments of the present invention have been described in detail herein and shown in the accompanying drawings, it will be evident that various further modifications or substitution of parts and elements are possible without departing from the scope and spirit of the invention.

We claim:

1. A sealed compressor, comprising:

an enclosure including a center shell extending along an axial length, and sealed at one end by an end cap, said end cap being welded to said center shell;

an electric motor housed within said center shell, and receiving a driveshaft extending along a drive axis;

a compressor pump unit mounted adjacent one end of said motor spaced from said end cap, and being connected to be driven by said driveshaft; and a lubrication system to transfer lubricant within said sealed compressor through said driveshaft and to said compressor pump unit, a magnet being held on said end cap by holding structure being positioned radially outwardly of said magnet, and said magnet being generally centered on said rotational axis of said driveshaft.

2. A compressor as recited in claim 1, wherein said holding structure includes a depression formed in said end cap which receives and positions said magnet.

3. A compressor as recited in claim 1, wherein said magnet is generally annular and having a central hollow bore.

4. A compressor as recited in claim 1, wherein said magnet is centered on said rotational axis.

5. A compressor as recited in claim 1, wherein said holding structure includes a member extending upwardly from said end cap to position said magnet.

6. A compressor as recited in claim 5, wherein said holding structure is formed integrally with said end cap.

* * * * *